United States Patent [19]

Tomlinson

[11] 4,106,690

[45] Aug. 15, 1978

[54] OPTIMUM START CONTROLLER

[75] Inventor: Colin Henry Tomlinson, Gravesend, England

[73] Assignee: Rochester Instrument Systems Limited, Crayford, England

[21] Appl. No.: 629,697

[22] Filed: Nov. 7, 1975

[30] Foreign Application Priority Data

Nov. 7, 1974 [GB] United Kingdom ..... 48326/74

[51] Int. Cl.[2] ..... F23N 5/20

[52] U.S. Cl. ..... 236/46 R; 165/12

[58] Field of Search ..... 236/91 R, 91 G, 91 D, 236/46 E, 46 R, 91 E, 78 B; 165/28, 12; 219/292

[56] References Cited

U.S. PATENT DOCUMENTS

| | | | |
|---|---|---|---|
| 2,569,530 | 10/1951 | Kramer et al. | 236/46 R |
| 2,719,672 | 10/1955 | Jenkins | 236/46 R |
| 2,778,571 | 1/1957 | Gaddis | 236/46 R |
| 2,832,870 | 4/1958 | Kucera | 236/46 R X |
| 3,301,482 | 1/1967 | Bullen | 236/46 R |
| 3,964,676 | 6/1976 | Rooks et al. | 236/46 R |

FOREIGN PATENT DOCUMENTS

| | | | |
|---|---|---|---|
| 1,193,711 | 6/1970 | United Kingdom | 236/46 R |

*Primary Examiner*—William E. Wayner
*Attorney, Agent, or Firm*—Eliot S. Gerber

[57] ABSTRACT

A programmed controller for controlling the start of a heating system includes a clock mechanism to produce a time-variable signal, two temperature transducers, one inside and one outside of the building, and an electronic circuit which is a proportional summing means to combine (in predetermined proportions) the electrical outputs of the two transducers, and an electronic circuit to combine the time variable signal with the summed transducer output signals to thereby produce a control signal for controlling a heating appliance, such as a boiler.

18 Claims, 4 Drawing Figures

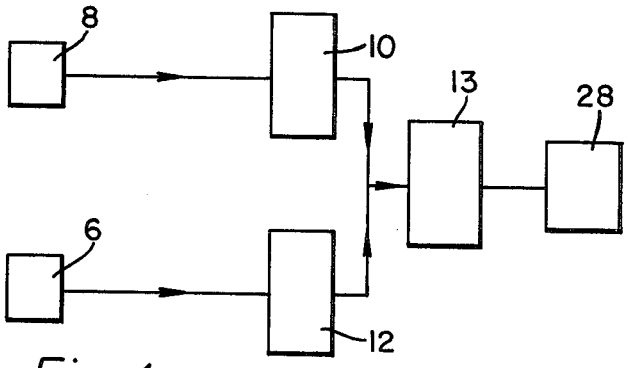
Fig. 1
Fig. 2
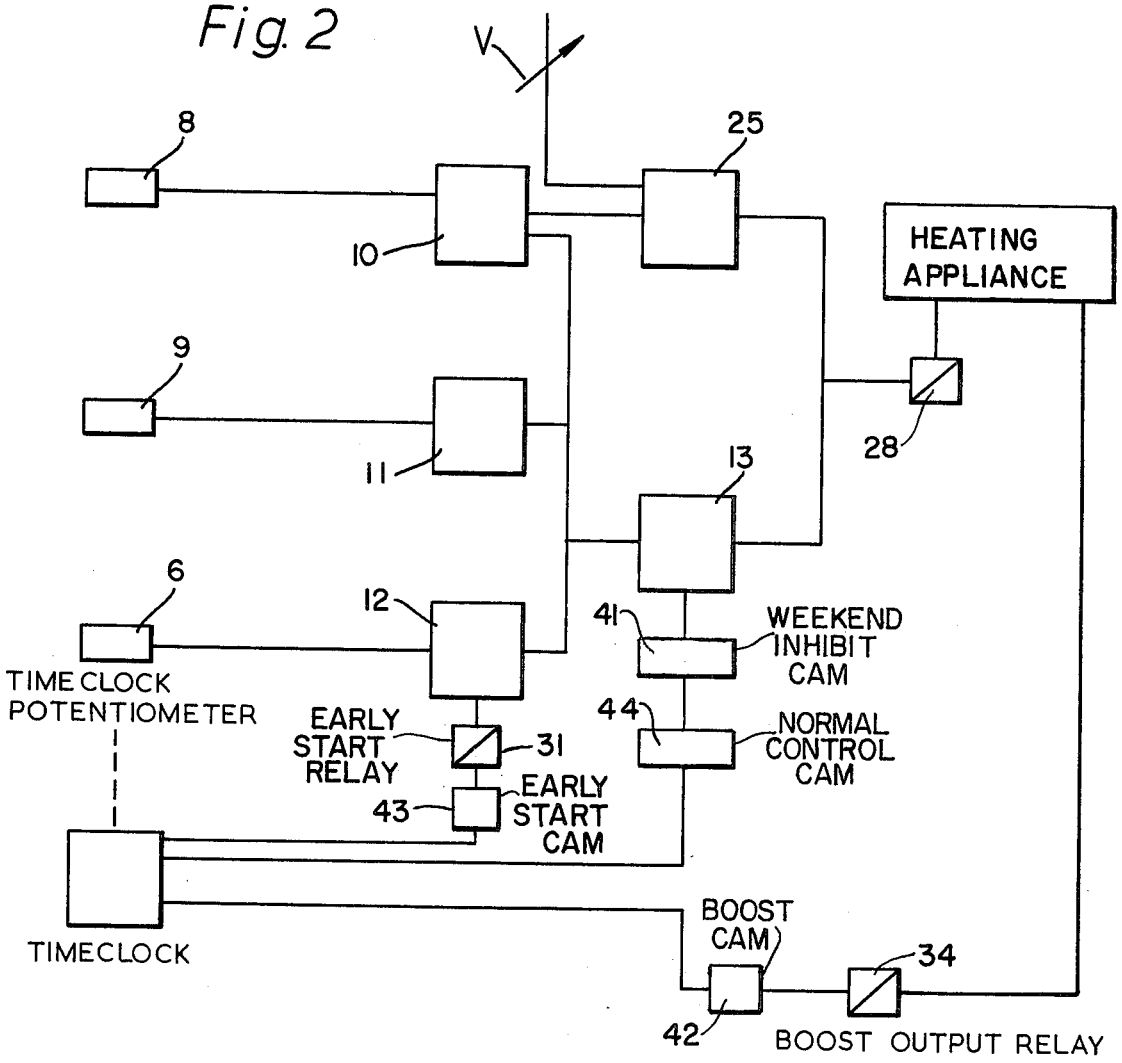

OPTIMUM START CONTROLLER

BACKGROUND OF THE INVENTION

This invention relates to a device for controlling the operation of a system for heating a building.

Known devices in the field of the invention, usually described as "programmed controllers", typically include a time clock which is used to start and stop a heating appliance which forms part of a system for heating a building. In the simplest case, the heating appliance is controlled by its own thermostat and by thermostats fitted, for example, to radiators installed in various rooms of the building. An improvement on such a system includes the use of "inside" and "outside" thermostats for controlling the appliance with regard to the weather. For example, more heat needs to be generated on cold days than on warm days. However, the time clock will still provide "start" and "stop" signals in accordance with a preset program and this can result in either insufficient heating in a building at the start of a cold day, or a waste of heat on a warm day when, for example, the temperature of the building reaches a comfortable level long before the building is occupied.

British Pat. No. 1,193,711 to Honeywell relates to "control of a thermal conditioning system". It mentions that prior computer systems "have not proved completely successful and are, of course, quite expensive". In the described system signals representing inside and outside temperatures appear to be directly fed to a Wheatstone bridge system, without predetermined proportioning. In U.S. Pat. Nos. 2,832,870 and 3,076,606 the morning warm-up period may be varied in duration, depending upon outside temperature. Other systems to vary the duration of the morning warm-up period are found in U.S. Pat. Nos. 2,778,571; 2,719,672 and 2,583,397. The present invention presents advantages, in terms of cost, accuracy or reliability, compared to the control systems of the above-named patents.

SUMMARY OF THE INVENTION

This invention seeks to provide a control device which can be used with an existing timer to adjust the heating program in accordance with prevailing conditions so as to improve fuel economy without reducing comfort.

According to the invention, a device for controlling the start of a heating system comprises means for producing a time-variable signal; a first temperature transducer for location on the inside of a building to be heated by said system; a second temperature transducer for location on the outside of said building; proportional summing means for combining the outputs of said first and second transducers in respective predetermined proportions; and means for combining said time variable signal with the output of said proportional summing means to produce an output to control a heating appliance forming part of said system.

Preferably, the device for producing a time-variable signal comprises a time clock having a twenty-four hour drive shaft coupled directly to means for varying an electrically measurable parameter, such as a variable resistance in the form of a potentiometer with a circular track. A ramp function may be continuously generated, for example, to avoid returning a potentiometer to a starting value and/or to avoid using a special cam which accounts for the "off period" when the building is empty and does not require to be heated, the ramp function generated during the "off period" being ineffective.

Preferably, biasing networks are provided for adjusting the outputs of the first and second temperature transducers and the means for generating the time-variable signal whereby the device may be "tuned" to suit the characteristics and requirements of the building in which the heating system is installed.

It is also preferred to employ a "frost" control which includes means for producing a signal under predetermined frost conditions and for combining this signal with the output of the first or "inside" temperature transducer to produce an output for operating the heating system for a sufficient time to increase the temperature of the building to a predetermined value.

BRIEF DESCRIPTION OF THE DRAWINGS

A preferred embodiment of the invention is described with reference to the accompanying drawings, in which:

FIG. 1 is a block diagram of a first embodiment of a control device according to the invention;

FIG. 2 is a block diagram of a second embodiment of a control device according to the invention;

DETAILED DESCRIPTION OF THE INVENTION

Figure 3:
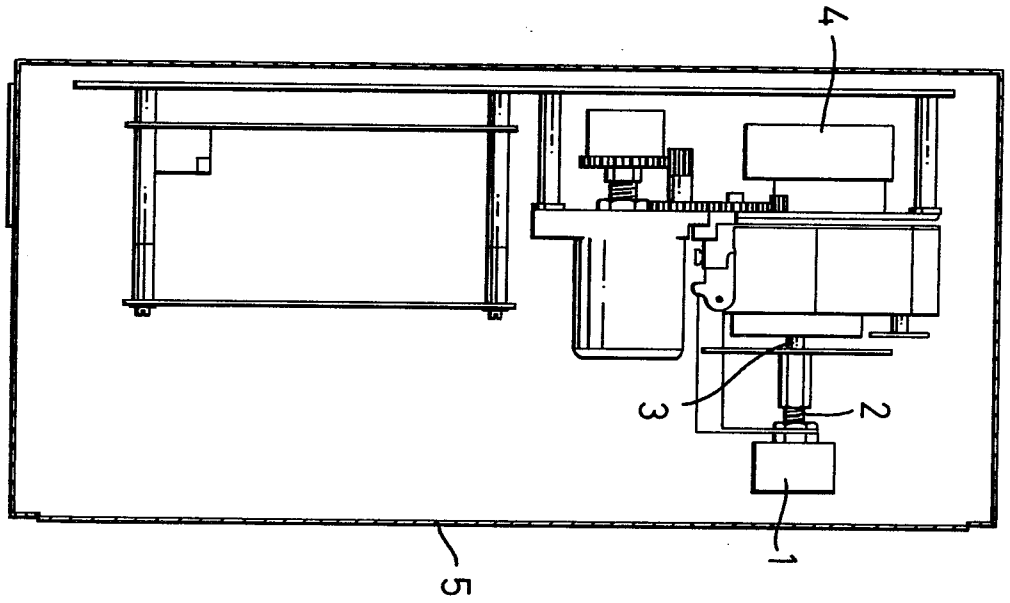
FIG. 3 is a side elevational and sectional view through a control device assembly.

In order to facilitate understanding of the invention, we shall first describe the nature of temperature control in a typical installation.

A typical programmed heating system, controlled by a preset time clock, will start to heat a building at some time before a comfortable temperature is required by the occupants. For example, the time clock will start a boiler at, say, 5:00 a.m. in the morning so that a suite of offices reaches a comfortable temperature when occupied by staff at 9:00 a.m. At the end of the day, the time clock switches off the boiler, possibly just before the offices close, so that the building cools naturally according to its heat losses.

If the weather becomes colder, it is necessary to switch the boiler on at an earlier time so that a comfortable temperature is reached at the start of the working day. On the other hand, in warm weather, a comfortable temperature is reached long before the start of the working day. With conventional time clock driven controls, the boiler is started at a preset time regardless of the outside temperature and thus the building may be too cold at the start of a cold day, or fuel may be wasted in reaching comfort conditions too soon on a warm day.

The invention seeks to provide a control device which is operative to adjust automatically at least the start of the heating appliance in accordance with ambient temperature. This can be achieved in practice by deriving a ramp-function signal, for example, from the track of a potentiometer having a slider which is driven by a time-clock, and summing the ramp function signal with a compatible signal derived from a temperature transducer, whereby an output signal is derived for starting the heating appliance in order to achieve comfortable temperature conditions at the start of the day. In order to obtain optimum pre-heat conditions, the heat output of the appliance is preferably boosted to 25% above the normal rated output for the building to be heated.

FIG. 1 shows a simple control device in accordance with one embodiment of the invention. A time-clock driven potentiometer 6 and an inside temperature detector 8 provide signals which are amplified by amplifiers 10 and 12. The outputs of amplifiers 10 and 12 are then summed before being supplied to an amplifier 13 for producing an output signal to operate a relay 28 which controls the heating appliance.

The resistance/time pattern of the time-clock driven potentiometer 6 is selected in accordance with the temperature range expected on the inside of the building and with the thermal capacity of the building. It is best to choose an approximately correct pattern by estimating the temperature range and heat losses and to make final adustments on site. During the "off-period" the potentiometer is driven but it is ineffective in the circuit. This is achieved by ensuring that during the heating period the resistance of the potentiometer is large and that during the "off" period the potentiometer resistance is taken out of circuit, for example, by a short-circuiting switch.

When there is a big drop in the "overnight" temperature of the building, for example, in a frost, a further control may be incorporated to raise the temperature of the building to a predetermined value before the true heating cycle commences. For example, the "frost" control cuts in at 10° and when 11° C is reached, the heating system will shut down. Should the room temperature fall below 10° C again during the off period, the operation is repeated until the normal start up point is reached. The system will then become operational under normal "optimum start" conditions.

I have so far described a control device that will automatically provide a pre-heat period to compensate for internal temperatures during the whole of the "off" period. My preferred controller also takes account of the variations in outside temperature. Briefly put, a proportional signal representing the outside temperature is combined with a proportional signal representing the inside temperature and the combined signal is summed with the signal from the track of a time-clock driven potentiometer to provide an output control signal. Proportional signals are used, for example, $ax + by$ where $x$ is the outside temperature signal, $y$ is the inside temperature signal and $a$ and $b$ are proportioning factors, because a change in the outside temperature has a different effect on the system than a change in the inside temperature. The starting time of the heating appliance is controlled by the summed signal whereby it is turned on to a boosted value (greater than its rated value) after a delay following the time when the time clock reaches the programmed starting point. The delay depends on the inside and outside temperature of the building. When the time clock reaches the start of the normal heating period, the "optimum start" circuit is cut out so that the appliance operates at its normal output depending on the heating load. The inside and outside transducers can, if required, form part of the control at normal load.

A schematic circuit of a control device based on the above is shown in FIG. 2. The output from a time-clock driven potentiometer 6, inside (building) and outside (building) temperature detectors or transducers 8 and 9, are amplified by amplifiers 10, 11, 12, summed and then amplified by amplifier 13 for operating a relay 28. A variable bias V is amplified with the output from detector 8 in amplifier 25 to provide "frost" compensation.

The signal from the outside detector 9 offsets the signal from the inside detector 8 so that the potentiometer signal is more effective to shorten the delay to start the appliance.

If the same program was required seven days per week, a standard pre-heat time could be incorporated. However, in the majority of buildings, a prolonged shutdown period (i.e. weekends) is very common and therefore a longer pre-heat period is required. To this end, a further adjustment is provided which is brought into circuit on the morning after a prolonged shutdown, to allow for an earlier start. This ensures that the building is up to the correct temperature just prior to occupancy. An embodiment of this feature will be explained below with reference to FIG. 4.

FIG. 3 shows a control device comprising a continuously variable potentiometer 1 having a shaft 2 directly coupled to the 24-hour shaft 3 of a time-clock 4. The time-clock 4, together with the components of a controller in accordance with an embodiment of this invention, are mounted within a case 5.

Figure 4:
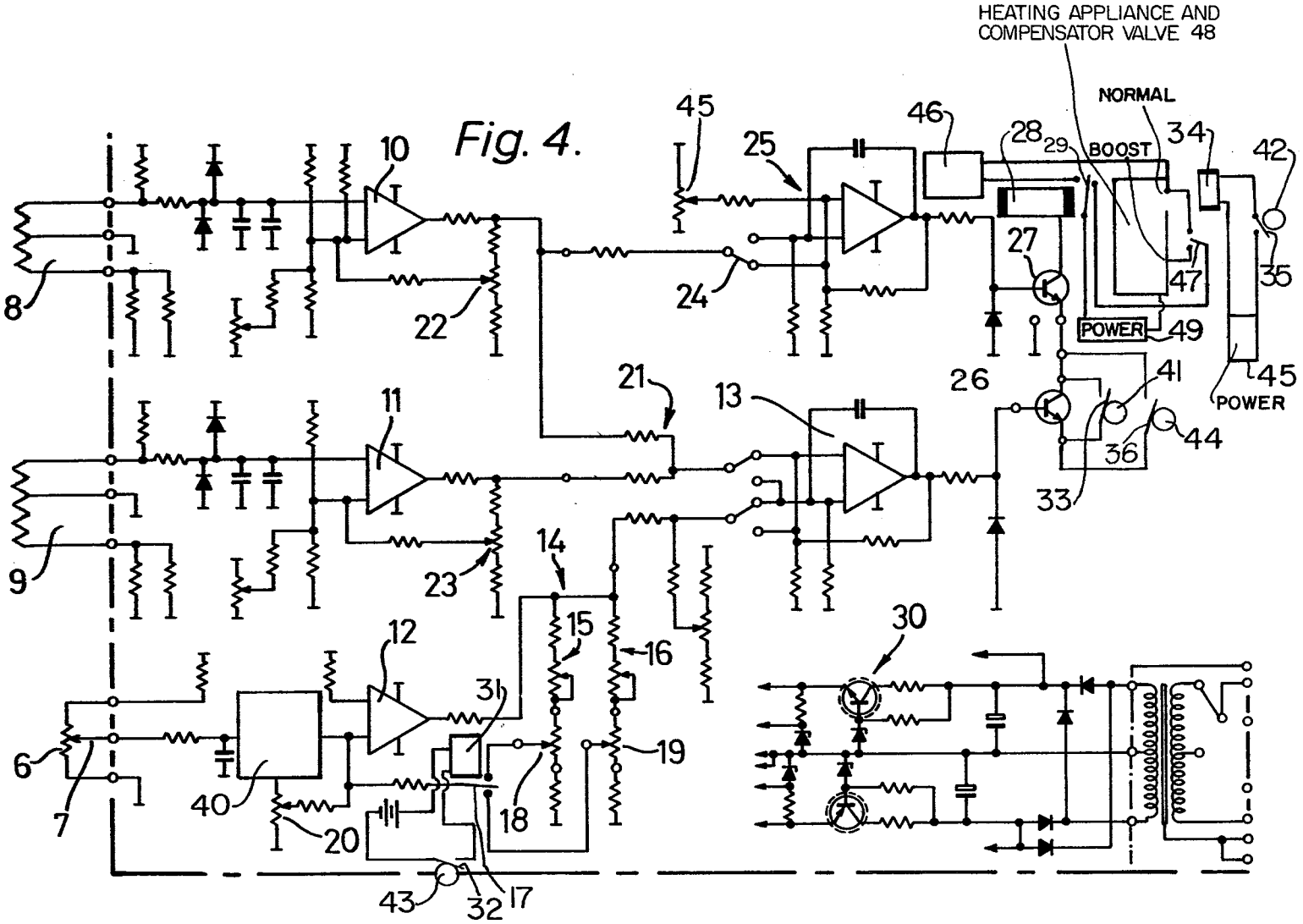
FIG. 4 shows a schematic circuit diagram of a controller based on the embodiment of FIG. 2.

Referring to FIG. 4, the track of the potentiometer 1 is shown by resistance 6 and the slider by reference 7. An "inside" thermostat 8 and an "outside" thermostat 9 are connected to the circuit for providing signals respectively proportional to the temperature on the inside and the outside of a building in which the heating system is installed.

Operational amplifiers 10, 11 and 12 are connected respectively to the "inside thermostat 8, the outside thermostat 9 and the potentiometer having track 6. These operational amplifiers are connected to a power supply 30 and are arranged to provide compatible output voltage signals which are combined in a resistance network 21 before being fed to one input of summing means 13, which summing means is constructed with an operational amplifier.

The output of amplifier 12 is connected to summing means 13 via a biasing circuit 14 comprising a pair of resistance networks 15,16, which may be selectively brought into circuit by means of changeover contacts 17 of a relay 31, for impressing a respective bias on the output of amplifier 12. Each resistance network 15,16 includes a variable resistance or potentiometer 18,19, respectively, for presetting the bias applied to the output of amplifier 12, for example, to suit the characteristics of the building in which the heating system is installed. The biasing circuit 14 derives power from a variable control 20 which is connected to the power supply 30.

The relay 31, which is energized by closure of a contact 32 in the time-clock, automatically controls the changeover of contacts 17 whereby the heating appliance can be started earlier following a prolonged shutdown (e.g. a weekend), as explained above.

The outputs of amplifiers 10,11 are resistance summed in proportion to the effect required (i.e., with regard to the ax + by function mentioned above) by the variable resistance network 21 before being supplied to the input of the operational amplifier forming parts of the summing means 13. Both amplifiers 10,11 have an adjustable offset 22,23, respectively, for adjusting their outputs to compatible levels (i.e., normalize).

The output of amplifier 10 is also coupled, through a switch 24, to summing means 25. Summing means 25 is also constructed from an operational amplifier. Summing means 25 can be selectively brought into circuit in order to compensate for a sudden frost, whereby the starting point of the heating appliance may be unduly delayed as explained above in connection with FIG. 3. The outputs of summing means 13,25 are supplied to respective output transistors 26,27, which are coupled to provide a common output signal for operating a relay 28 which controls contacts 29 which cause the heating appliance to operate under either normal or boost conditions. Transistor 26 is short circuited by contacts 33, which contacts are operated by the time-clock and are connected across transistor 26. A relay 34, controlled by time-clock contacts 35, closes contacts (not shown) to cause the heating appliance to operate under boost conditions. A time-clock contact 36 operates as a day control to cause the appliance to operate under normal load conditions where the "optimum start" circuit is cut out.

The function of the circuit shown in FIG. 4 is as follows:

The time-clock is programmed in accordance with the heating requirements of a building and one of the biasing circuits 15,16 is selected and adjusted in accordance with the thermal characteristics of the building. As a time-clock operates, the slider 7 moves across the track 6 producing a resistance. This "resistance" signal is converted to a voltage signal by amplifier 12 as are the signals derived from detectors 8,9 by means of amplifiers 10,11. The resistance network 21 provides a summed signal which is fed to one input of the summing means 13 and the other input receives the bias signal from the time-clock driven potentiometer. Summation of these signals by the summing means 13 provides a signal to biase the base of transistor 26. The conduction point of transistor 26 depends on the sum of the signal from network 21 and the biased potentiometer signal from network 14. Transistor 27 is normally conductive but is provided to interrupt the current to the relay solenoid 28 in accordance with the above-mentioned control parameters concerning frost protection. For example, the signal from amplifier 10 is summed with a reference value from an adjustable potentiometer 22 to produce a signal for biasing the base of transistor 27. Conduction is controlled in transistor 27 so as to provide a short operating cycle of the heating appliance to boost the inside temperature to a reference level as explained above.

Thus, assuming that the heating system has just shut down at night, the signal from the time switch is greater than the combined signal from the inside room detector and the outside detector and the output relay will be energized to ensure that the boiler and pump circuits are broken. A three-way valve (not shown) associated with the compensator and controlled by contacts 35 on the time clock, via an interposing relay, has been run to the fully opened position to provide a boost condition.

During the night, if the inside temperature falls below a pre-set minimum (in-built into the controller as a frost and condensation protection normally set to 10° C), then the control relay, associated with the boilers and pump circuits, will de-energize, starting the pump and boiler up to circulate hot water throughout the building to keep it at the minimum temperature of 10° C within the building. To take account of varying needs, the frost protection setting on the controller can be adjusted between 5° and 15° C but will normally set at 10° C.

The optimum start time is initiated by the time-clock contacts 33 which operate at shutdown. These contacts energize the output relay 28 bringing into circuit the time clock potentiometer 6 and the inside and outside detectors 8 and 9.

The signals from the two detectors are normalized by their respective amplifiers to give an analog voltage signal proportional to the input ranges. Also the signal from the time-clock potentiometer is normalized to give an analog signal proportional to time. The gain of this amplifier is adjustable by means of a calibrated dial. The preferred adjustment would be to set the output signal of the potentiometer amplifier for a particular time equal to the combined output of the two temperature detectors so that the reference and transducer signals are of compatible values. However, if the boiler exceeds the normal load requirements an alternate setting may be made. This provides the adjustment for variable boiler capacities. The valve which controls normal and boost boiler capacity is set to match the compensator building on installation to give the maximum fuel economy.

If the inside and outside temperatures are on the lower limit and the time clock reaches the set time before occupation, then the sum of two analog signals from the detectors via amplifiers 10 and 12 and are equal to the signal provided from the potentiometer 6 via amplifier 25 is detected by amplifier 13 and whose output, if low, de-energizes the output relay 28 which energizes the boiler and pump controls. If, however, the inside or outside air temperature suddenly increases, the combined signal from the detectors and the potentiometer will re-energize the output relay 28 and the system will stop.

If there is no sudden rise in the inside or outside temperature, then the system will switch on when the two signals are greater than the conduction point of the transistor and will remain on until occupation time. The time switch contacts 33 will inhibit the optimum control and the plant will operate on normal day control, i.e., boiler and pump circuits made by relay 28 de-energized and the compensator switches to normal control by means of timer contact 35. At night again the time switch returns to optimum control by means of contact 33 and 35 enables the compensator to run to boost condition. Thus the unit is ready for the next optimum control period.

To cater for early morning switch on, after a prolonged shutdown, i.e., weekend, the time switch potentiometer time period is modified to the early morning setting by means of relay 31 via time switch contact 32 for the day of the week it is required.

At prolonged shut down, i.e., weekend, the time switch contact 33 inhibits the optimim start control but the frost protection control is maintained from the inside temperature via amplifiers 10 and 25. Thus the building is maintained at 10° C or higher day and night while vacated until early morning start control is initiated.

If, for any reason, the power to the controller fails then time synchronization will be maintained for 72 hours via the clock spring reserve, but the control system will switch to normal day working while loss of power exists.

The control switches and dials on the optimum start controller will provide the following functions.

Normal Day Setting Dial

This provides a variable heating period to match the building and boiler requirements for a normal optimum cycle. The range can be field adjusted between 4 and 9 hours.

Early Morning Setting Dial

This provides a larger variable heating period to match the building and boiler requirememts after a prolonged shutdown, i.e., weekends. The range can be field adjusted between 4 and 12 hours.

Four Position Selector Switch (1) The "OFF" Position - This switches off the supply to the time clock and the control system, but due to the fact that the clock has a 72-hour spring reserve, then time synchronization will be maintained for this period.

With power to the control system off, the output relay will be de-energized thus enabling normal control on the compensator and boiler/pump switched on. This is the normal variant but if the unit is required to operate in the reverse direction, i.e., boiler and pump off, compensator to boost position, this can also be achieved. The reason for this position is to remove power from the clock and control system for maintenance and allow the heating system to perform without optimum control.

(2) Normal Day - In this position the power to the clock circuit is on but the control system is switched off. The boiler and pump circuits are ON and the compensator is on normal control. Thus normal day working is maintained 24 hours a day.

(3) Night Control - The time-clock and control system are both switched on but the optimum control is inhibited except for frost protection. The boiler and pumps are off except under frost conditions and compensator is on boost condition, i.e., 3-way valve is fully open. The plant is normally switched off but under control of frost and condensation protection if the inside temperature falls below a set value. (4) Auto - The time-clock and control system are both switched on. The boiler and pump circuits are controlled in accordance to the optimum start cycle and the compensator switches automatically when boost night/normal day.

Time Switch Control Cams

Cam 41 - Control Switch 33 - This controls the optimum start output by inhibiting its operation during the prolonged shutdown period but the frost protection control is operational.

Cam 42 - Control Switch 35 - This provides control on the compensator boost/normal relay 34. Relay energized for boost control.

Cam 43 - Control Switch 32 - This provides early morning option after a prolonged shutdown period by switch relay 31.

Cam 44 - Control Switch 36 - This provides the optimum start control section and ensures that during the day normal day operation is obtained.

As a safety precaution, a control can be included in the circuitry of the preferred embodiment for shutting down the heating system should the inside temperature exceed a predetermined value.

What is claimed is:

1. A device for controlling the start of a heating appliance forming part of a heating system in a building comprising means for producing a time-variable signal comprising a time clock having a 24-hour drive shaft and means for varying an electrically measurable parameter, said drive being coupled directly to said varying parameter means;

and including a variable biasing circuit for adjusting said time-variable signal to modify the control to suit the characteristics of a building in which the heating system is installed;

and including means coupled to said means for producing said time-variable signal for automatically adjusting said time-variable signal to cause said appliance to be started earlier, prior to a heating period following an interval more prolonged than the daily cooling cycle of the heating system;

a first temperature transducer located on the inside of said building; a second temperature transducer located on the outside of said building; proportional summing means for combining the outputs of said first and second transducers in respective predetermined proportions; and control means for combining said time variable signal with the output of said proportional summing means to produce an output to control said heating appliance.

2. A device according to claim 1 wherein said time-variable signal is a ramp function.

3. A device according to claim 1 and including a "frost" control means connected to said control means and responsive to a predetermined inside temperature relating to a frost, for causing the heating system to heat the building to a predetermined higher temperature and thereafter to shut down said heating system.

4. A device according to claim 1 wherein said summing means comprises an operational amplifier.

5. A device according to claim 1 including respective operational amplifiers for amplifying the outputs from said first and second temperature transducers, adjustable biasing networks for each of said amplifiers to respectively normalize the outputs from said first and second transducers.

6. A device according to claim 3 wherein said "frost" control means includes means for deriving an output representing said predetermined inside temperature, means for normalizing said inside temperature deriving means to produce a further output, said further output being summed with a variable reference means to produce said output for controlling said heating appliance.

7. A device according to claim 1 wherein said 24-hour clock has a spring motor for use on electrical failure.

8. A device for controlling the start of a heating appliance forming part of a heating system in a building comprising a 24-hour clock having an output shaft, a resistor having a variable track and a slider, said slider being directly coupled to said output shaft for producing a time-variable electrical signal, including means coupled to said clock for automatically adjusting said time-variable signal to cause said appliance to be started earlier, prior to a heating period following an interval more prolonged than the daily cooling cycle of the heating system, a first temperature transducer located on the inside of said building; a second temperature transducer located on the outside of said building; proportional summing means for combining the outputs of said first and second transducers in respective predetermined proportions; and control means for combining said time variable signal with the output of said proportional summing means to produce an output to control said heating appliance.

9. A device according to claim 8 wherein said time-variable signal is a ramp function obtained from said track.

10. A device according to claim 8 wherein said 24-hour clock has a spring motor for use on electrical failure.

11. A device according to claim 8 including respective operational amplifiers for amplifying the outputs from said first and second temperature transducers, adjustable biasing networks for each of said amplifiers to normalize the outputs from said first and second transducers.

12. A device according to claim 8 and including a "frost" control means connected to said control means and responsive to a predetermined inside temperature relating to a frost for causing the heating system to heat the building to a predetermined higher temperature and thereafter to shut down said heating system.

13. A device according to claim 12 wherein said "frost" control means includes means for deriving an output representing said predetermined inside temperature, means for normalizing said inside temperature deriving means to produce a further output, said further output being summed with an adjustable reference means to produce said output for controlling said heating appliance.

14. A device for controlling the start of a heating appliance forming part of a heating system in a building comprising means for producing a time-variable signal including means coupled to said means for producing said time-variable signal for automatically adjusting said time-variable signal to cause said appliance to be started earlier, prior to a heating period following an interval more prolonged than the daily cooling cycle of the heating system; a first temperature transducer located on the inside of said building; a second temperature transducer located on the outside of said building, including respective operational amplifiers for amplifying the outputs from said first and second temperature transducers, adjustable biasing networks for each of said amplifiers to respectively normalize the outputs from said first and second transducers; proportional summing means for combining the outputs of said first and second transducers in respective predetermined proportions; and control means for combining said time variable signal with the output of said proportional summing means to produce an output to control said heating appliance.

15. A device according to claim 14 in which said means for producing a time-variable signal comprises a time clock having a 24-hour drive shaft and means for varying an electrically measurable parameter , said drive being coupled directly to said varying parameter means.

16. A device according to claim 14 and including a "frost" control means connected to said control means and responsive to said predetermined inside temperature relating to a predetermined higher temperature and thereafter to shut down said heating system.

17. A device according to claim 16 wherein said "frost" control means includes means for deriving an output representing said predetermined inside temperature, means for normalizing said inside temperature deriving means to produce a further output, said further output being summed with an adjustable reference means to produce said output for controlling said heating appliance.

18. A device according to claim 14 wherein said 24-hour clock has a spring motor for use on electrical failure.

* * * * *